US007240449B2

(12) United States Patent
Clifton, Jr.

(10) Patent No.: US 7,240,449 B2
(45) Date of Patent: Jul. 10, 2007

(54) FIREARM SAFETY SYSTEM

(76) Inventor: Norman E. Clifton, Jr., 1736 St. Johns Bluff Rd., South, Jacksonville, FL (US) 32246

( * ) Notice: Subject to any disclaimer, the term of this patent is extended or adjusted under 35 U.S.C. 154(b) by 0 days.

(21) Appl. No.: 10/685,966

(22) Filed: Oct. 15, 2003

(65) Prior Publication Data

US 2005/0115132 A1 Jun. 2, 2005

(51) Int. Cl.
*F41A 17/42* (2006.01)
*F41A 17/34* (2006.01)

(52) U.S. Cl. ..... 42/70.11; 42/70.02

(58) Field of Classification Search ..... 42/70.01, 42/70.11, 70.02

See application file for complete search history.

(56) References Cited

U.S. PATENT DOCUMENTS 4,567,810 A * 2/1986 Preston ..... 89/142
4,835,892 A * 6/1989 Ruger et al. ..... 42/7
4,896,447 A * 1/1990 Badoni ..... 42/95
5,311,691 A * 5/1994 Cacek ..... 42/1.01
5,419,069 A * 5/1995 Mumbleau et al. ..... 42/70.11
5,488,794 A * 2/1996 Arrequin ..... 42/70.11
5,680,724 A * 10/1997 Peterken ..... 42/70.11
5,732,498 A * 3/1998 Arreguin ..... 42/70.11
5,768,816 A * 6/1998 Rassias ..... 42/70.11
6,141,895 A * 11/2000 Rost et al. ..... 42/6

* cited by examiner

*Primary Examiner*—Stephen M. Johnson
(74) *Attorney, Agent, or Firm*—Arthur G. Yeager

(57) ABSTRACT

A firearm safety system includes a magazine block having a pair of opposed parallel shoulders slidably inserting beneath a pair of respective lips at an upper portion of a magazine and positionable in a loading chamber of a firearm to trap the charging handle to make it inoperable. Once the magazine block is positioned within the loading chamber, the firearm cannot operate because the magazine block inhibits ammo rounds from entering the loading chamber and prevents a spring-loaded bolt and firing pin from moving forward for propelling ammo rounds. The firearm safety system may operate in a stealthy mode by attaching the magazine block to a cover plate including a pair of resilient elements for locking to a female receptor notch of the magazine block thereby rendering the magazine block, loading chamber, ejection port and a portion of at least one loaded spare magazine hidden. To ensure a secure locked position, the cover plate cannot be unlocked from the magazine block until the magazine is pulled downwardly away from the loading chamber.

32 Claims, 8 Drawing Sheets

FIREARM SAFETY SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to a firearm safety system and, more particularly, to a stealthy firearm safety system attachable to a firearm magazine and insertable into a loading chamber.

2. Related Art

Since the events of Sep. 11, 2001, armed security personnel more frequently monitor crowded public places such as public buildings, bridges, chemical and electrical generating plants and airports, for example. The attacks unfortunately showed how vulnerable the public can be to terrorism and the like. Often, terrorists/criminals can be deterred from committing crimes of violence if armed security personnel are conspicuously visible, especially those who carry automatic or semi-automatic firearms.

Such firearms may be worn around the operator's shoulder, for example, so that the operator may position his hands and fingers near the trigger of the firearm for quick operation. However, automatic and semi-automatic firearms are capable of repeatedly firing many rounds and can cause extensive damage if the operator accidentally activates the trigger.

As is apparent, public places are usually crowded and noisy. Therefore, if the operator is not cautious, people may bump into him or he may become distracted by noise and thereby unintentionally move his fingers towards the trigger. Unintentional movement of the operator's fingers may activate the firearm trigger and thereby potentially injure or kill innocent bystanders. To assist in the prevention of such accidents, many firearms have safety locks. Unfortunately, safety locks can be accidentally toggled to an off position without the operator's knowledge and can fail after repeated use. Such a shortcoming can be fatal for obvious reasons. Moreover, safety buttons are typically positioned on the exterior of the firearm thereby allowing would-be terrorists/criminals to determine whether the firearm is in an operable mode. Such a shortcoming reduces the effectiveness for deterring would-be terrorists/criminals.

Other firearm safety means include removing a magazine from the firearm until the operator needs to operate the firearm. Unfortunately, not having a magazine inserted into the firearm quite obviously also notifies the public that the firearm is not operable. Should the operator need to operate the firearm, precious time and effort are required to locate, grasp and insert a loaded magazine into the firearm. This provides a terrorist/criminal extra time to commit a crime and escape from the scene.

Accordingly, the present invention, together with U.S. Pat. No. 6,327,805 directed to a Double Magazine Clamping Device, overcomes such shortcomings by employing a stealthy firearm safety system that is not visible to the public and able to switch a firearm from a non-operating mode to an operating mode with minimum time and effort.

BRIEF SUMMARY OF THE INVENTION

In one aspect of the present invention there is provided a firearm safety system for attachment to an upper end of a magazine for preventing the operation of a firearm having a loading chamber, a spring-loaded bolt and firing pin assembly, an ejection port flap and means for automatically locking and releasing a magazine from a loading chamber comprising an elongate magazine block including a lower portion removably attachable to an upper end of a magazine to locate the magazine block in such loading chamber and an upper portion extending substantially vertically from the lower portion to entrap the charging handle so as to eliminate its function of engaging the bolt and firing pin assembly into a firing chamber of a firearm thereby rendering such firearm inoperable and a near side portion adjacent an ejection port flap and far side portion. There is also a stiff plastic cover plate having an upper end portion that covers the ejection port and a lower extending generally outwardly and downwardly from the upper end portion, the upper portion including means for locking the cover plate to the magazine block, the means being positionable through an ejection port of a firearm for engaging the block for locating the cover plate to hide the block and an ejection port flap from plain view. The means for locking includes a laterally extending male member having a pair of spaced elongate resilient elements, each of which includes an outwardly extending locking shoulder for releasably connecting the element to the upper portion of the magazine block. The upper portion of the block includes a female receptor notch in the upper portion of the block for receiving the male member, the resilient elements partially passing transversely through the receptor notch to dispose the locking shoulder of each element on a far side of the receptor notch. The receptor notch includes a pair of substantially opposed parallel end walls extending between the side portions of a predetermined spacing, the elements being spaced apart to fit within the spacing when the cover plate becomes locked to the magazine block.

Each element has a free end bendable into the receptor notch when the element engages an end wall of the receptor notch, the elements substantially returning to an initial condition after the locking shoulders are disposed on the far side of the receptor notch. Each locking shoulder engages a respective end wall to inhibit horizontal movement of elements, the cover plate being releasable from the block when a magazine carrying the block is removed vertically downwardly from a firearm. The receptor notch further includes an unencumbered upper passage, the magazine block being pulled downward from a firing chamber of a firearm by withdrawal of a magazine carrying the magazine block for causing movement of the passage below the elements and disengagement of the pair of locking shoulders from the magazine block thereby releasing the cover plate to freely fall downward away from a firearm. The magazine and ejection port cover has an outer surface including an upper panel extending generally downwardly integral with a downwardly and outwardly extending middle panel integral with a substantially downwardly extending lower panel, the cover plate generally conforming and overlying an upper portion of a spare magazine adjacent and spaced away from the firearm and a magazine carrying the magazine block. The cover plate further includes a pair of spaced and opposed sides extending perpendicularly from the lower panel so that a portion of a spare magazine is covered between the opposed sides of the cover plate. The lower portion of the magazine block includes a pair of opposed shoulders for receiving a top portion of a magazine thereby being removably engagable to a magazine. The opposed pair of shoulders extend substantially parallel to a length of the lower portion from a rear end to generally midway the length of the lower portion. The magazine block is formed from stiff plastic. The male member extends generally horizontally when the cover is locked to the magazine block. The receptor notch includes a generally horizontal bottom wall, and the resilient elements are supported by the bottom wall when the cover is locked to the magazine block. The block includes a pair of spaced elongated and parallel shoulders disposed on opposite sides of the block spaced upwardly from a bottom of the lower portion, the shoulders being slidably disposable respectively below spaced overlying lips at the top opening of a magazine. Each resilient element includes a free end movable to permit passage of the locking shoulder through the receptor notch and being resilient to move to position said locking shoulders disposed outwardly on a far side of the receptor notch after the locking shoulders pass through the receptor notch.

In a further aspect of the invention there is provided a firearm safety system for attachment to an upper end of a magazine for preventing the operation of a firearm having a loading chamber, a spring-loaded bolt and firing pin assembly, an ejection port and means for automatically locking and releasing a magazine from a loading chamber comprising an elongate magazine block including a lower portion having a pair of opposed shoulders for slidably inserting the block into the upper end of a magazine to locate the magazine block in a loading chamber, and an upper portion extending substantially vertically from the lower portion to prevent forward movement of a spring-loaded bolt and firing pin assembly into a loading chamber of a firearm, thereby rendering such firearm inoperable. The system also includes a cover plate having an upper end portion and a lower extending generally outwardly and downwardly from the upper end portion, the upper portion including means for locking the cover plate to the magazine block, the means being positionable through an ejection port of a firearm for engaging the block for locating the cover plate to hide the block and an ejection port flap from plain view.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
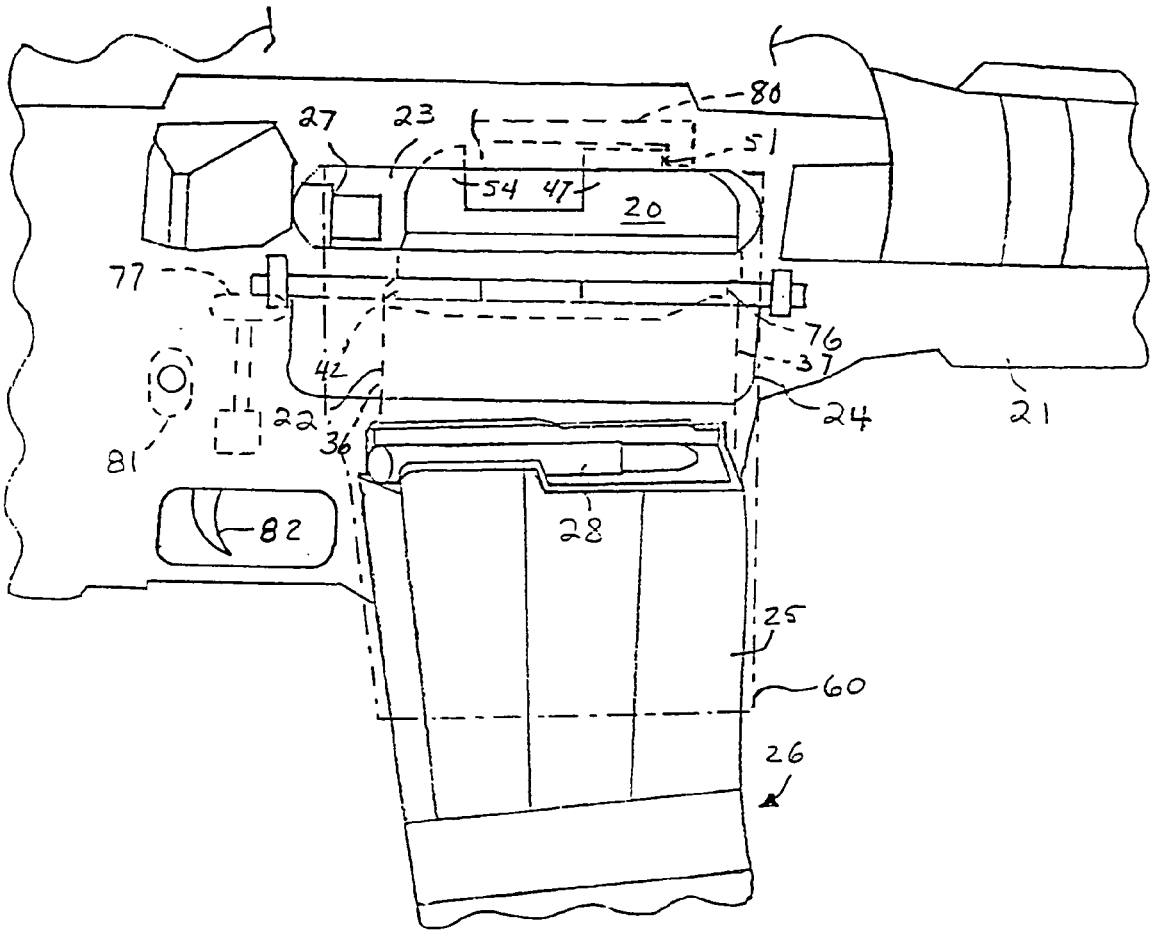
FIG. 1 is a side elevational view of a portion of a firearm including a magazine carrying a magazine block positioned inside a loading chamber of the firearm, in accordance with the present invention.

Referring initially to FIG. 1, a firearm safety system embodying the present invention includes an elongate magazine block 20. The magazine block 20 is shown attached to a magazine 22 against spring-loaded magazine follower 30 or loaded rounds in place of one or two rounds removed from the upper end of the magazine 22 and is positioned in a loading chamber 23 of firearm 21 adjacent to an ejection port 24 of a firearm 21. A fully loaded spare magazine 25 having rounds 28 loaded therein is connected to magazine 22 by connection means 26 as shown and described in U.S. Pat. No. 6,327,805, incorporated herein by reference.

The magazine block 20 is designed for use with an AR-15 rifle including charging handle 80, bolt release 77, magazine release 81, trigger 82 and spring-loaded bolt and firing pin assembly 27 all standard components as understood in the art. The block 20 can be adapted for use in other firearms.

Figure 2:
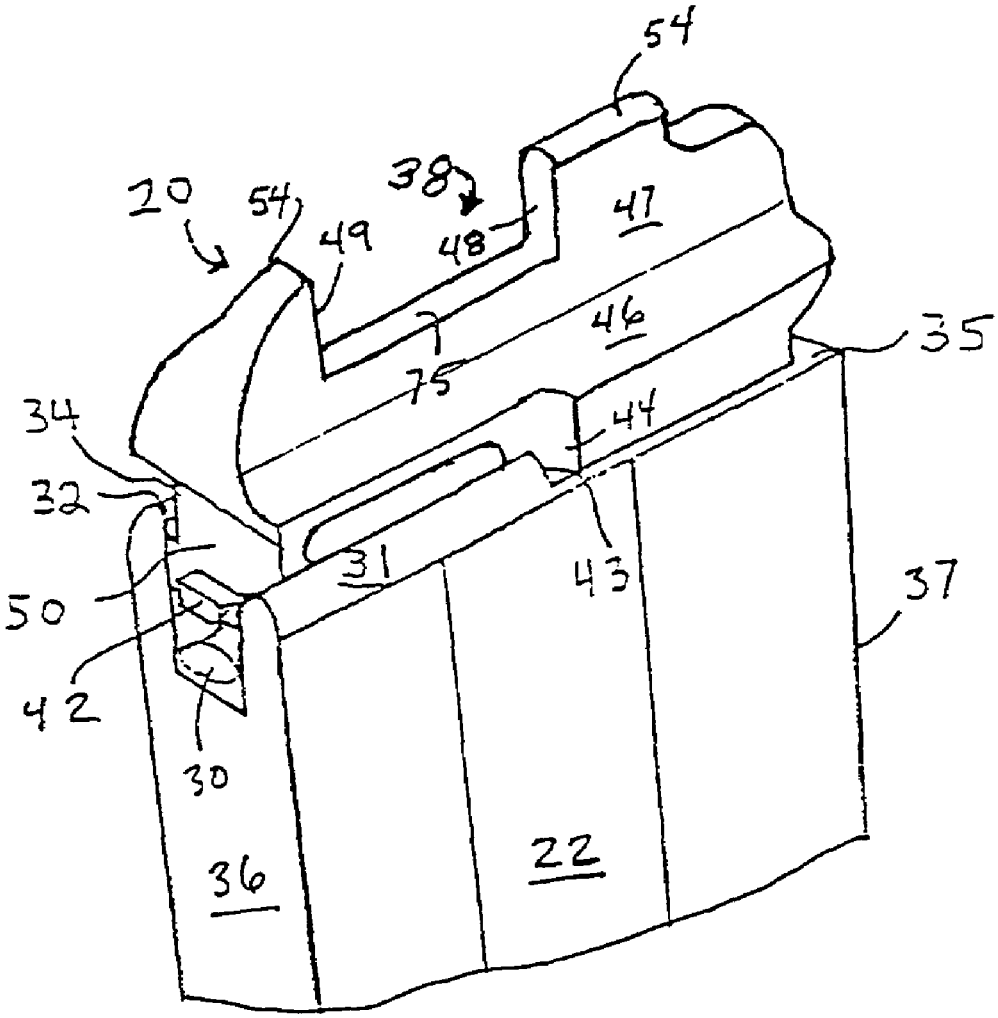
FIG. 2 is a perspective view of the magazine block attached to the upper portion of a magazine shown in FIG. 1.
Figure 3:
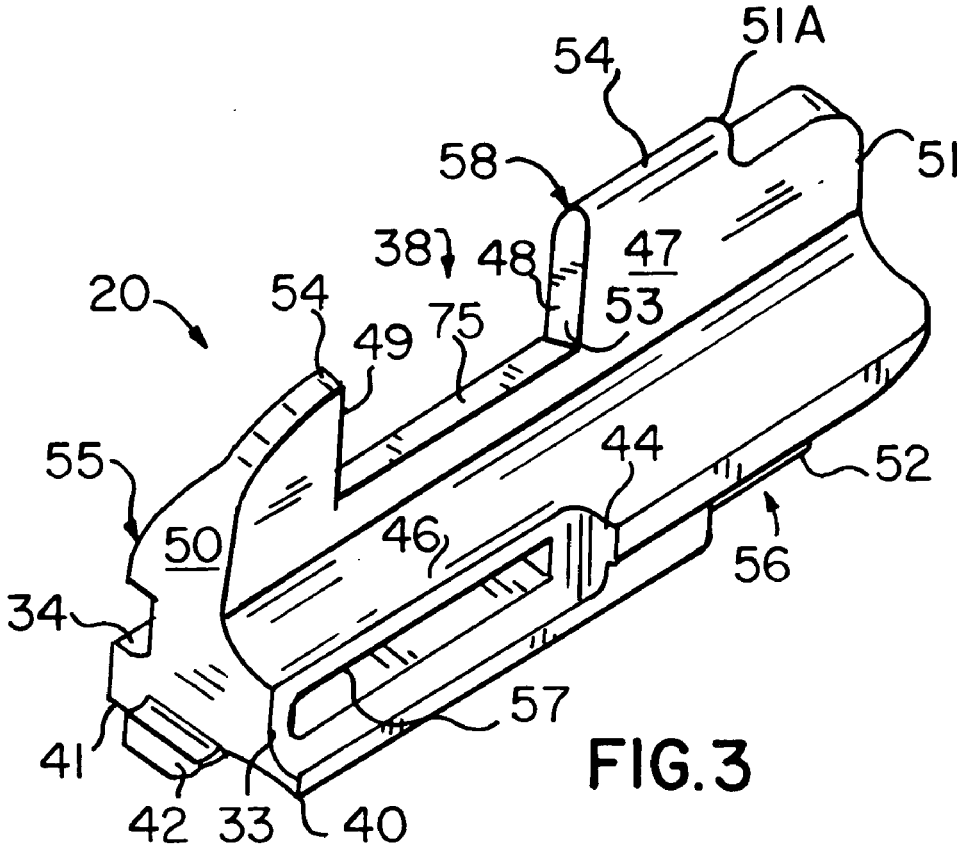
FIG. 3 is an enlarged view of the magazine block of FIG. 2.
Figure 4:
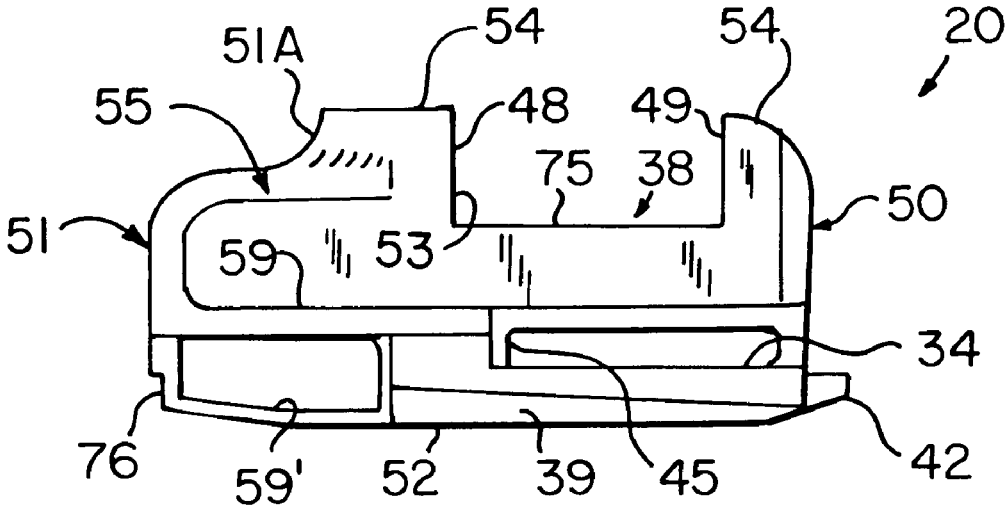
FIG. 4 is an enlarged elevation view showing the front end portion and far side of the magazine block of FIG. 2.

Now referring to FIGS. 2, 3 and 4, the elongate magazine block 20 includes a pair of spaced elongate parallel shoulders 33, 34 disposed on opposite sides of the block 20. Shoulders 33, 34 are spaced upwardly from the bottom of a lower portion 39 of the block 20 and are slidably disposable, respectively, below spaced overlying lips 31, 32 of magazine 22 at the upper end 35 thereof. The shoulders 33, 34 curve upwardly and inwardly a predetermined distance toward the upper portion 58 of the block 20 and along the rear-end 50 thereof. Projecting tab 42 contacts the bolt stop lock inside the magazine area of the weapon.

Shoulders 33, 34 extend substantially parallel to the longitudinal axis of the block 20 and within the lower portion 39, beginning from the rear end 50 of the magazine block 20 to generally midway the length of the lower portion 39 and ending at stops 44, 45, respectively. Each shoulder 33, 34 has a substantially planar bottom surface 40, 41 for smoothly sliding against lips 31, 32 extending between rear and front walls 36, 37 respectively as the block 20 is inserted into magazine 22. Stops 44, 45 together with the laterally extending portions of rear end 50 of the block 20 preferably prevent forward or rearward movement of block 20 along lips 31, 32 while the block 20 is inserted in magazine 22.

In particular, the magazine block 20 is slidably inserted rearwardly into the upper end 35 of magazine 22 by disposing the shoulders 33, 34 beneath a pair of elongated receiving lips 31, 32, respectively of the upper end 35 of the magazine 22. A spring loaded magazine follower 30 housed by the magazine 22 provides an upwardly directed force for maintaining surface contact between the bottom surface 40, 41 of the shoulders 33, 34 or bullets stacked between follower 30 and the block 20 and the receiving lips 31, 32, as well known in the art.

The front end 51 of the magazine block 20 is generally slanted upwardly from bottom surface 52 so that the magazine block 20 does not catch the front end 37 of the magazine 22 when a force from the rear 50 pushes forwardly to eject the block 20 from the magazine 22. The magazine block 20 may be removed from the magazine 22 in generally the same way a round 28 is removed from the magazine 22, as well known in the art.

The upper portion 58 of the magazine block 20 includes a substantially planar face 47 descending substantially vertically from a top portion 54 thereof and curving outwardly to smoothly intersect top face 46, planar face 47 being located generally midway between the near and far sides 56, 55 of the magazine block. Such a planar face 47 extends along the length of magazine block 20, between opposed rear and front ends 50, 51. A predetermined portion of the upper portion 58 is cut out for defining female receptor notch 38. Cavities 57 and 59' reduce the weight of the block 20.

The female receptor notch 38 is formed generally medially between the rear and front ends 50, 51 of the magazine block 20 and extends vertically from generally midway up face 47 to the top 54 of the magazine block 20. The receptor notch 38 includes an unencumbered vertical passage 53, as will be discussed hereinafter. The female receptor notch 38 further includes a substantially planar bottom surface 75 extending from and slightly slanted upwardly from the near side 47 to the far side 55 thereof. The width of the female receptor notch 38 spans a predetermined distance defined between opposed slightly slanted end walls 48, 49, which is sufficient to receive a locking male member 61 of the cover plate 60 (discussed below) therethrough and allows the magazine block 20 to be vertically unlocked or released from the cover plate 60 when it is desired, to remove the safety system from the firearm 21. The width of the female receptor notch 38 depends upon the width of the male member 61, and can be set at a variety of predetermined lengths.

To install the safety system, the magazine block 20 is inserted in place of one or two rounds of ammo at the top of magazine 22 and then pushed into the loading chamber 23 of the firearm 21 in the conventional manner well known in the art. The result is that the magazine block 20 substantially fills the loading chamber 23 and holds the charging handle 80 in the forward position in engagement with front end 51.

Once the magazine block 20 fills the loading chamber 23 and holds the handle 80, the firearm 21 is rendered inoperable because the height of the magazine block 20 is greater than the height of the loading chamber 23 and thereby blocks the forward movement of a spring loaded bolt and firing pin assembly 27 from entering the loading chamber of a firearm when the trigger 82 of the firearm 21 is activated, as best shown in FIG. 1. The operator cannot pull the bolt 27 via charging handle 80 from the locked open position held by block 20 because of the engagement of projecting tab 42 with bolt lock 77 of firearm 21. As a result, the bolt assembly 27 cannot move the block 20 forwardly if bolt 27 is disengaged from its locked position because surface 76 rests against front wall 37 of the magazine 22 and the block 20 cannot move laterally due to its attachment to the magazine 22. This ensures the bolt 27 will be in a safe position when the magazine is removed (without a round 28 in the chamber 23). The firearm 21 can become operable only if the magazine block 20 is removed from the loading chamber 23.

Simply positioning the magazine block 20 into the loading chamber 23 of the firearm 21 activates the firearm safety system. In such an embodiment, the magazine block 20 is not hidden from plain view because when the magazine block is positioned in the loading chamber 23, the ejection port flap 24 of the firearm 21 is prevented from closing and thereby exposes the magazine block 20. Such an embodiment thereby does not provide a stealthy firearm safety system. Nevertheless, such an embodiment is effective for rendering the firearm 21 inoperable when stealth is not necessary.

Figure 5:
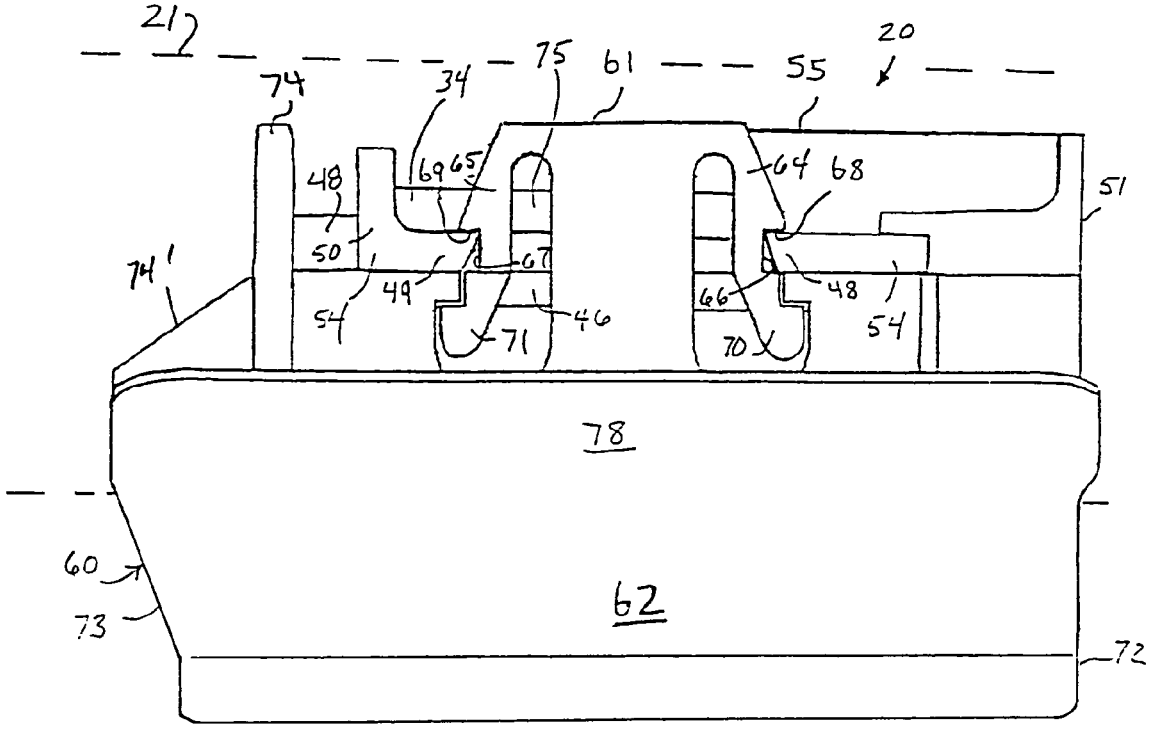
FIG. 5 is an enlarged top elevation view of an ejection port cover in a locked position with the magazine block installed in a firearm, in accordance with the present invention.
Figure 6:
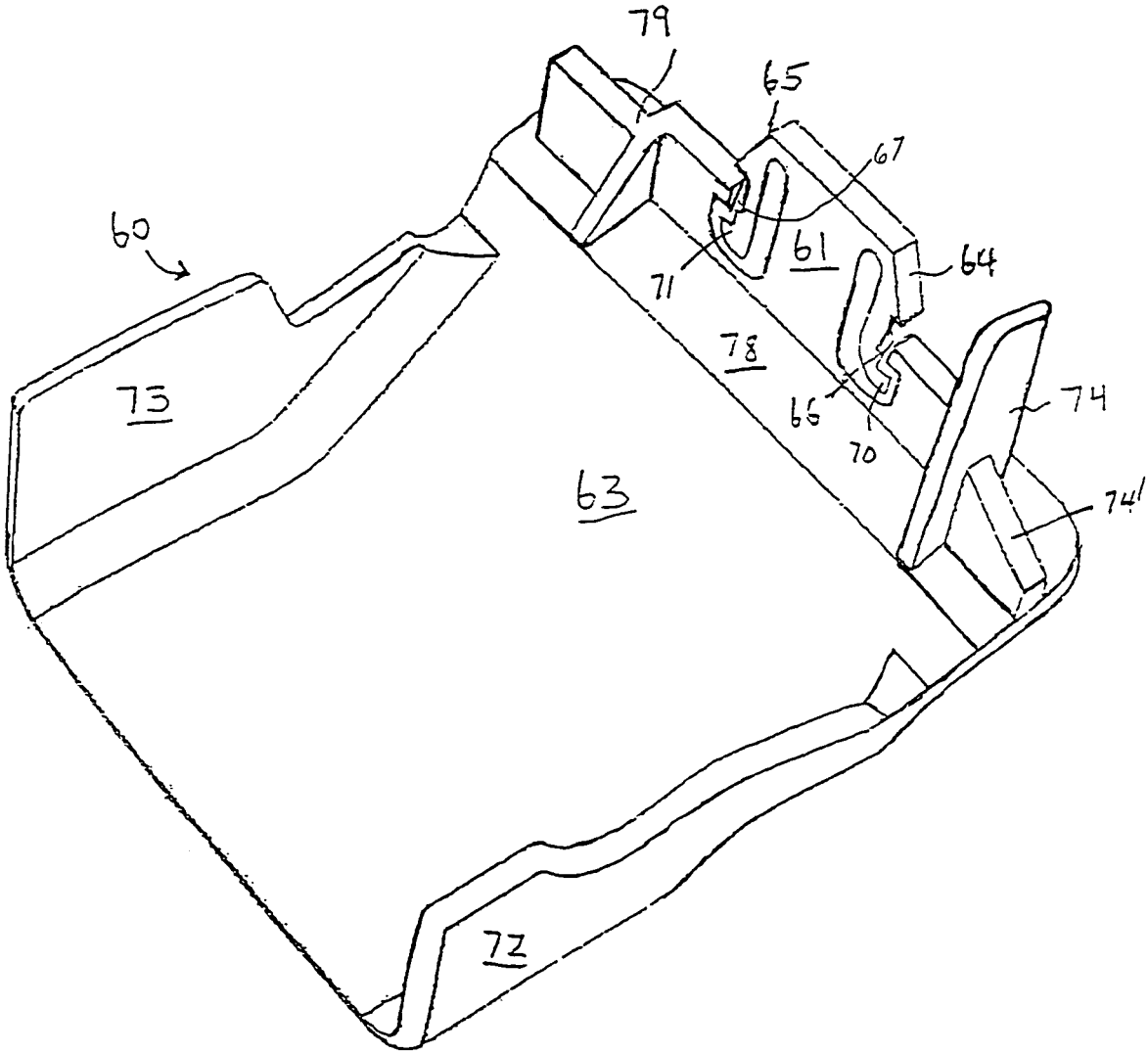
FIG. 6 is an enlarged perspective view showing the inside surface of the cover plate shown in FIG. 5.

Now referring to FIGS. 5 and 6, a cover plate 60 is attached to the magazine block 20 after same is positioned into the loading chamber 23 of a firearm 21. Accordingly, the magazine block 20 and a portion of the loaded spare magazine 25 become hidden from plain view. Such an embodiment provides a stealthy firearm safety system so that a non-operator such as a criminal, for example, cannot determine whether the firearm 21 is readily operable.

The cover plate 60 includes a non-planar top surface 62, which includes a plurality of generally planar surfaces connected at opposed ends and angled in such a manner to generally produce an overlying shape covering the ejection port with or without flap 24 and the loaded spare magazine 25. Of course, the orientation of the planar surfaces may vary and is shown herein as generally conforming in shape to the loaded spare magazine 25. It is important to cover the open ejection port, the block 20 and the auxiliary magazine 25, as much as possible in an unobtrusive manner and without interfering with the user to render the firearm 21 ready in a quick manner.

A pair of spaced, parallel and opposed sides 72, 73 extend generally perpendicularly from the bottom surface 63 and are integral therewith. Each side has a free end that has a lower portion extending, from a lower end of the cover plate 60, into a generally arcuate portion to approximately a top end 78 thereof. The respective arcuate portions allow the cover plate 60 to generally cover the opposed end walls 36, 37 of the spare magazine 25 so that at least a portion of the spare magazine 25 is rendered hidden. Accordingly, a non-operator cannot determine whether the spare magazine 25 is loaded, particularly when the firearm is being carried across the chest of the user.

Figure 7:
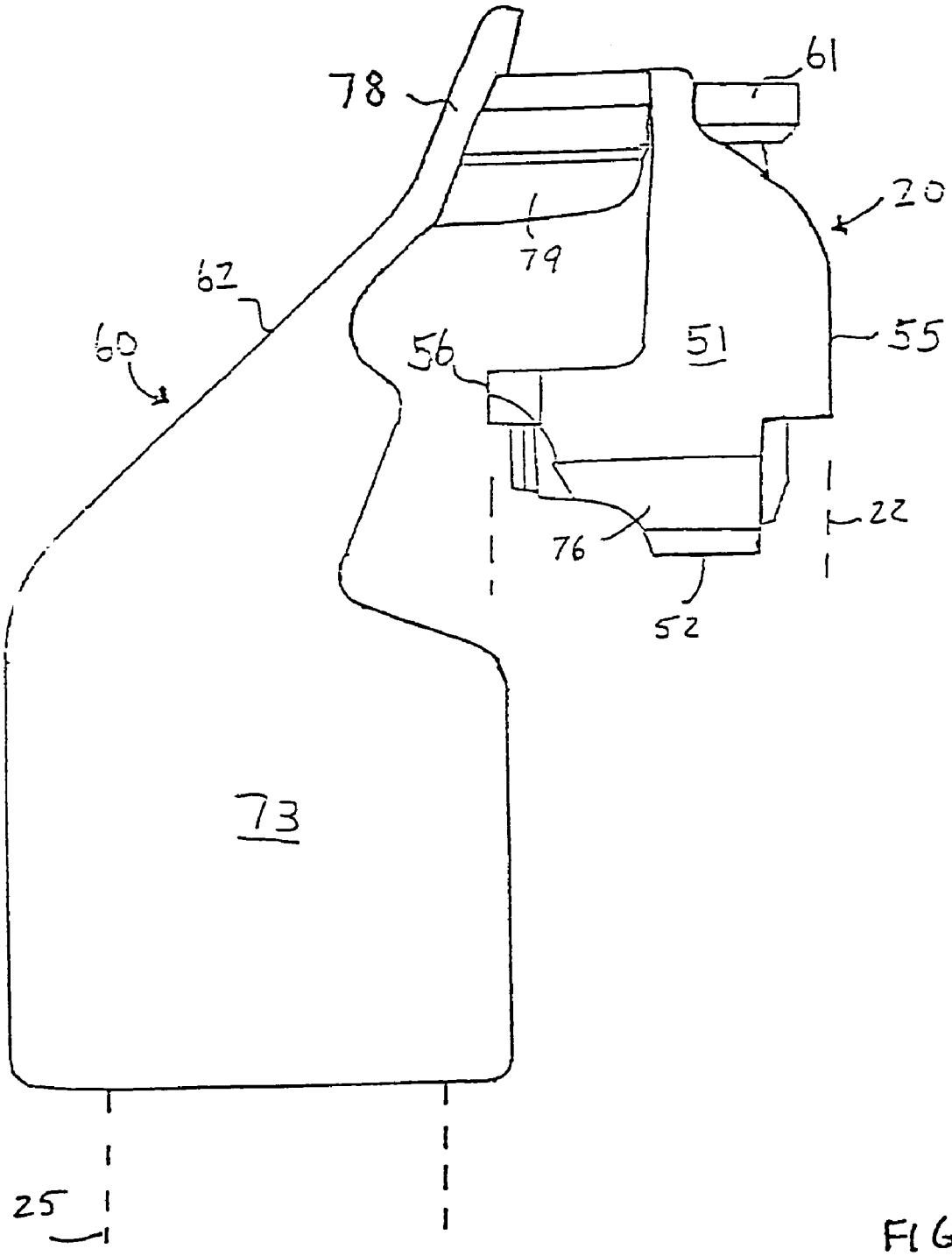
FIG. 7 is a front side elevational view of FIG. 5.

To lock the cover plate 60 with the magazine block 20, a male member 61 of the cover plate 60 must be inserted into the female receptor notch 38 of the magazine block 20, as shown in FIGS. 5 and 7. Referring back to FIG. 6, the male member 61 extends substantially perpendicularly and outwardly from the top end 78 of the cover plate 60. In particular, the male member 61 extends from the bottom surface 63 of the top end 78 and is integral therewith.

The male member 61 includes a pair of opposed elongate resilient elements 64, 65 integral therewith at one end. The pair of resilient elements 64, 65 are spaced apart on either side of the male member 61 and diverge away therefrom and extend downwardly and end with respective opposed free ends 70, 71. Thus, the greatest distance between the pair of resilient elements 64, 65 is at opposed free ends 70, 71. Such a distance between free ends 70, 71 is preferably greater than the distance between the pair of end walls 48, 49 of the female receptor notch 38, which receive the pair of resilient elements 64, 65, respectively. Accordingly, the pair of free ends 70, 71 move toward each other as the male member 61 traverses across the female receptor notch 38 and engages the pair of end walls 48, 49 at respective notches 66, 67.

Such notches 66, 67 are positioned generally midway the opposed ends of the resilient elements 64, 65, respectively, as perhaps best shown in FIGS. 5 and 6. Each notch 66, 67 has an open or unencumbered outer edge facing away from the male member 61 and towards the end walls 48, 49 of the female receptor notch 38, respectively. Such notches 66, 67 have predetermined cross sections sufficient to engage the respective end walls 48, 49. Of course, such cross sections can differ in alternate embodiments without departing from the spirit and scope of the present invention.

To assist locking the notches 66, 67 with such end walls 48, 49, each flexible member 64, 65 includes an angled portion extending outwardly from its top end away from the male member 61 and ending with respective locking shoulders 68, 69 at notches 66, 67, respectively. The shoulders 68, 69 form the far side of notches 66, 67 and maintain surface contact with the far sides of end walls 48, 49, respectively. To ensure the cover plate 60 remains securely locked to the magazine block 20, notches 66, 67 must maintain continuous contact with the end walls 48, 49. Otherwise, the cover plate 60 may not maintain its locked position and thereby disengage from the magazine block 20 when the operator handles the firearm 21.

To achieve continuous contact between end walls 48, 49 and notches 66, 67, the free ends 70, 71 of the resilient elements 64, 65 move inward as the male member 61 is inserted across female receptor notch 38. The resilient elements 64, 65 slide along the end walls 48, 49, as noted above, in a generally perpendicular direction thereto and thereby are caused to move inward toward the center of the male member 61.

Because the free ends 70, 71 of the resilient elements 64, 65 move inward from a relaxed position, such movement creates a resistive force. This force maintains surface contact between notches 66, 67 and shoulders 68, 69 and end walls 48, 49, respectively. The resistive force substantially decreases after the notches 66, 67 lock with end walls 48, 49 and helps to relieve the pressure exerted on the resilient elements 64, 65. However, such resistive force is maintained at a sufficient level for keeping the cover plate 60 locked to the block 20.

Ejection tab 74 and flange 79 extend substantially perpendicular from the top end 78 of the cover plate 60 in a manner similar to the male member 61. The members 74, 79 are integrally formed with cover 60 and assist in stabilizing the block 20 within the loading chamber 23.

The cover plate 60 preferably may be unlocked from the magazine block 20 by removing the magazine block 20 from the loading chamber 23. The magazine block 20 may be swiftly removed from the loading chamber 23 by pressing the release button 81 on the firearm 21 and pulling the magazine 22 downwardly and away from the firearm 23. The magazine block 20 may be unlocked from the cover plate 60 in such a manner because each end wall 48, 49 is substantially planar and the female receptor notch 38 is unencumbered thereby permitting the end walls 48, 49 to slide downward and below the notches 66, 67, respectively.

The loading chamber is now free to receive a loaded spare magazine 25 for rendering the firearm 21 operable. When the loaded spare magazine 25 is inserted into the loading chamber 23, the cover plate 60 is ejected outward and away from the loading chamber 23 and falls to the ground, for example. Bolt action against ramp member portion 74' of ejection tab 74 will force cover 60 out of the way if it does not fall away by itself.

Advantageously, the present invention provides a stealthy firearm safety system for firearms employing magazines and allows the operator to quickly activate/deactivate the safety system with minimal time and effort and to render the firearm operable. The magazine block 20 and cover plate 60 are preferably formed from stiff plastic, but can also be formed from other suitable materials as well known in the art.

Figure 8:
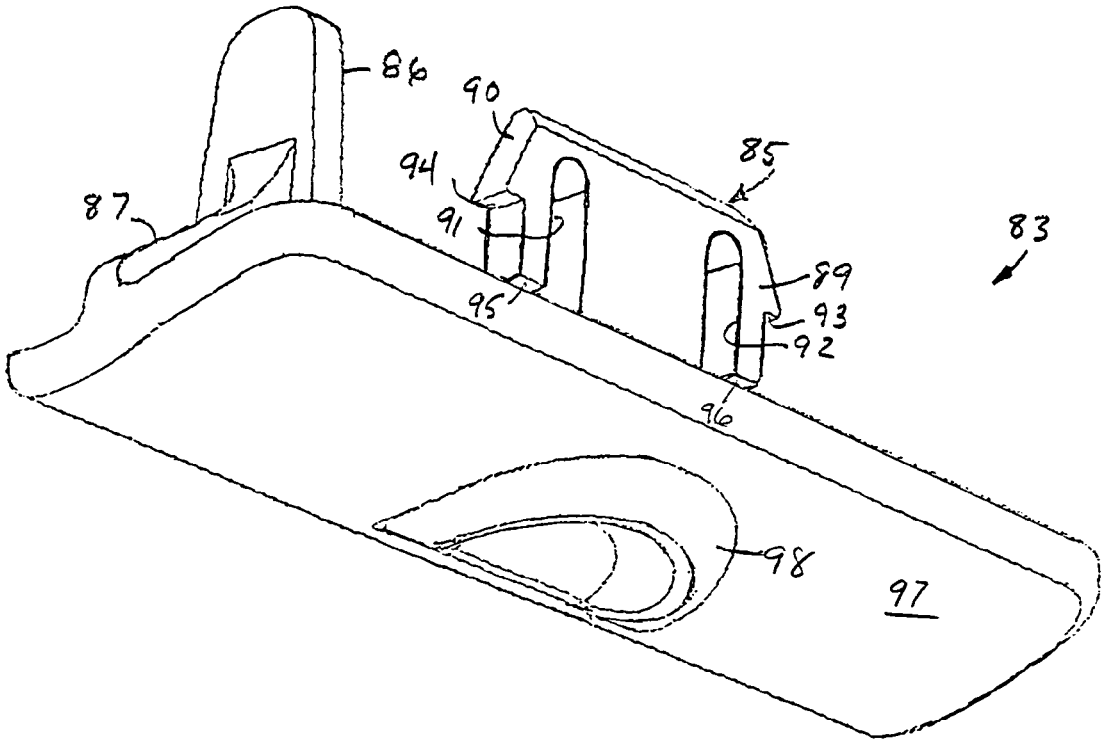
FIG. 8 is a perspective view of a second ejection port cover in accord with the present invention.
Figure 9:
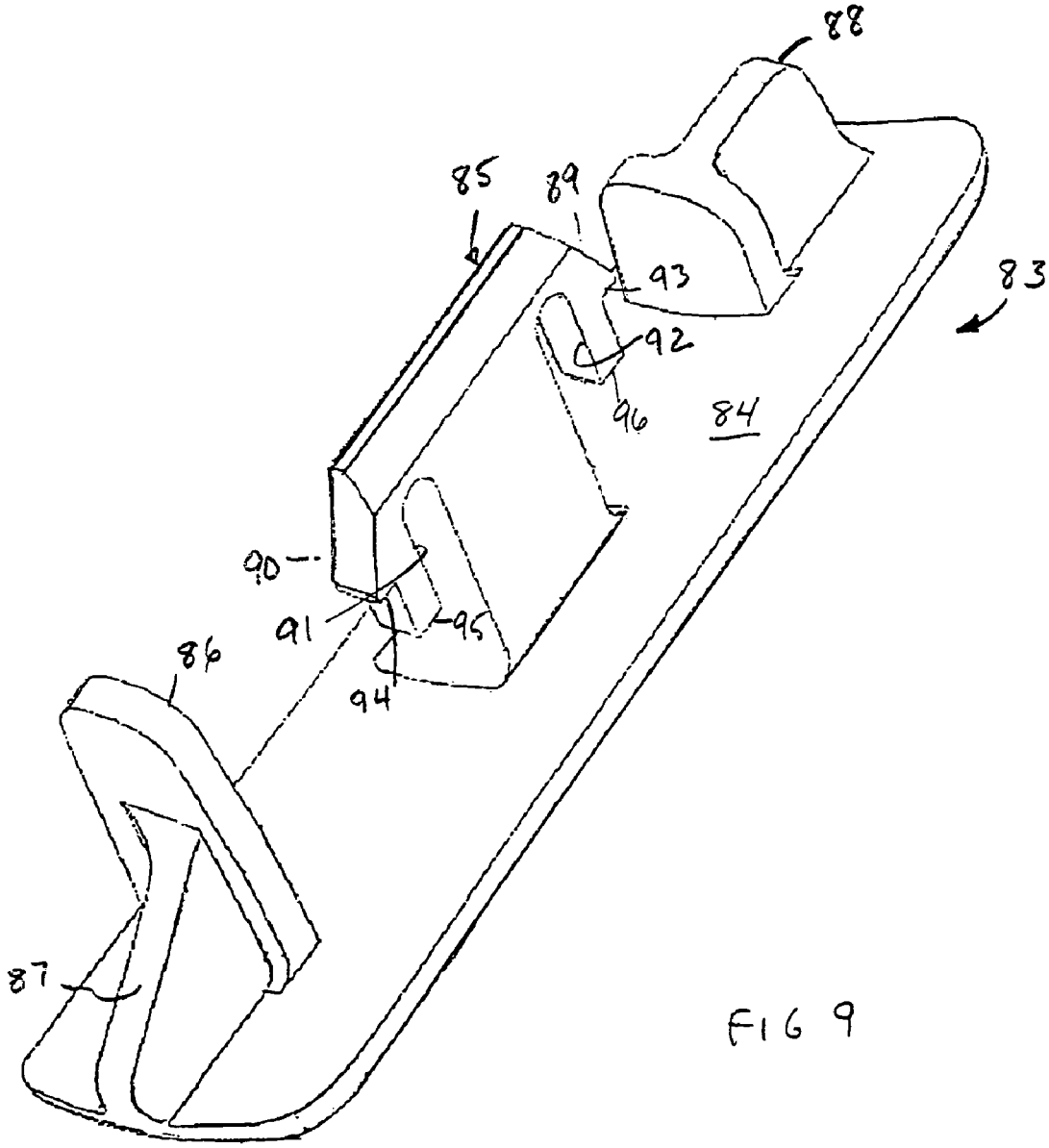
FIG. 9 is another perspective of the cover of FIG. 8.

With respect to FIGS. 8 and 9, a second embodiment of an ejection port cover 83 is illustrated. Cover 83 is used in applications where a spare magazine 25 is not carried, as was described hereinabove. One side 84 includes a locking male member 85 fitting into receptor notch 38 and an ejection tab 85 with a ramp member portion 87. A projecting element 88 that assists in holding the cover 83 in an ejection port 24.

A pair of flexible members 89, 90 have notches 92, 91 locking shoulders 93, 94 and end portions 96,95 all substantially identical to that of cover 60. A second side 97 includes a thumb pad 98 for use in installing the cover 83 into a port 24.

Bolt action will impact on ramp portion 87 to cause the cover to fall away if removal of a magazine 22 does not cause the cover to drop out.

While the present invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A firearm safety system for attachment to an upper end of a magazine for preventing the operation of a firearm having a loading chamber, a movable bolt and firing pin assembly, an ejection port and means for automatically locking and releasing a magazine from such loading chamber, said safety system comprising:

a single member in the form of an elongate single unitary magazine block including an integral lower portion formed in a shape to be removably slidably insertable into and completely carried by an upper end of such magazine for locating said magazine block in such loading chamber simultaneously when such magazine is inserted into such loading chamber and an integral upper portion substantially filling such loading chamber between its opposed ends to locate said upper portion of said block in such loading chamber when such magazine carrying said magazine block is inserted into such loading chamber to prevent forward movement of such movable bolt and such firing pin assembly into such loading chamber of such firearm thereby rendering such firearm inoperable and a near side portion adjacent such ejection port and far side portion.

2. The safety system of claim 1, further comprising a cover plate having an upper end portion and a lower portion extending generally outwardly and downwardly from said upper end portion, said upper portion including means for locking said cover plate to said magazine block, said means being positionable through such ejection port of such firearm for engaging said block for locating said cover plate to hide said block and such ejection port from plain view.

3. The safety system of claim 2, wherein said cover plate is formed from stiff plastic.

4. The safety system of claim 2, wherein said means for locking includes a laterally extending male member having a pair of spaced elongate resilient elements, each of said elements including an outwardly extending locking shoulder for releasably connecting said element to said upper portion of said magazine block.

5. The safety system of claim 4, wherein said male member extends generally horizontally when said cover is locked to said magazine block.

6. The safety system of claim 4, wherein said upper portion of said block includes a female receptor notch in said upper portion of said block for receiving said male member, said resilient elements partially passing transversely through said receptor notch to dispose said locking shoulder of each said element on a far side of said receptor notch.

7. The safety system of claim 6, wherein each said resilient element includes a free end movable to permit passage of said locking shoulder through said receptor notch and being resilient to move to position said locking shoulders disposed outwardly on a far side of said receptor notch after said locking shoulders pass through said receptor notch.

8. The safety system of claim 6, wherein said receptor notch includes a pair of substantially opposed parallel end walls extending between said side portions defining a predetermined spacing; said elements being spaced apart to fit within said spacing when said cover plate becomes locked to said magazine block.

9. The safety system of claim 8, wherein said receptor notch includes a generally horizontal bottom wall, said resilient elements being supported by said bottom wall when said cover is locked to said magazine block.

10. The safety system of claim 8, wherein each said element has a free end bendable into said receptor notch when said element engages a said end wall of said receptor notch, said elements substantially returning to an initial condition after said locking shoulders are disposed on said far side of said receptor notch.

11. The safety system of claim 10, wherein each said locking shoulder engages a respective said end wall to inhibit horizontal movement of elements, said cover plate releasable from said block when such magazine carrying said block is removed vertically downwardly from such firearm.

12. The safety system of claim 10, wherein said receptor notch further includes an unencumbered upper passage, said magazine block being pulled downward from such loading chamber of such firearm by withdrawal of such magazine carrying said magazine block for causing movement of said passage below said elements and disengagement of said pair of locking shoulders from said magazine block thereby releasing said cover plate to freely fall downward away from such firearm.

13. The safety system of claim 1, further comprising a cover plate having an outer surface including an upper panel extending generally downwardly integral with a downwardly and outwardly extending middle panel integral with a substantially downwardly extending lower panel, said cover plate generally conforming and overlying an upper portion of a spare magazine adjacent and spaced away from such firearm and such magazine carrying said magazine block.

14. The safety system of claim 13, wherein said cover plate further includes a pair of spaced and opposed sides extending perpendicularly from said lower panel so that a portion of such spare magazine is covered between said opposed sides of said cover plate.

15. The safety system of claim 1, wherein said shape of said lower portion of said magazine block defines a pair of integral opposed fixed-position shoulders for receiving a top portion of such magazine thereby being removably insertable into such magazine.

16. The safety system of claim 15, wherein said opposed pair of shoulders extend substantially parallel to a length of said lower portion from a rear end to generally midway the length of said lower portion.

17. The safety system of claim 1, wherein said magazine block is formed from stiff plastic.

18. The safety system of claim 1, wherein said block includes a pair of spaced elongated and parallel shoulders disposed on opposite sides of said block spaced upwardly from a bottom of said lower portion, said shoulders being slidably disposable respectively below spaced overlying lips at the top opening of such magazine when said block is inserted into such magazine.

19. The safety system of claim 1 wherein said block includes a front end portion and a rear end portion, said front end portion including a projecting tab for engaging a charging handle of such firearm to inhibit movement of such movable bolt and firing pin assembly.

20. The safety system of claim 1 wherein said block includes a front end portion and a rear end portion, said rear end portion including a projecting tab for engaging a bolt catch to hold such bolt catch in a lock back position to inhibit operation of such firearm.

21. A firearm safety system for attachment to an upper end of a magazine for preventing the operation of a firearm having a loading chamber, a charging handle, a bolt catch, a movable bolt and firing pin assembly, an ejection port and means for automatically locking and releasing such magazine from such loading chamber, said safety system comprising:

an elongate single unitary magazine block including an integral lower portion formed in a shape defining a pair of fixed-position opposed shoulders for slidably inserting said block into the upper end of such magazine for locating said magazine block in such loading chamber when such magazine is located in such loading chamber, and an integral upper portion substantially filling such loading chamber when such magazine is inserted thereinto to prevent forward movement of such movable bolt and firing pin assembly into such loading chamber of such firearm, thereby rendering such firearm inoperable.

22. The safety system of claim 21 further comprising a cover member having an upper end portion and a lower portion extending generally outwardly and downwardly from said upper end portion, said upper portion including means for locking said cover member to said magazine block, said means being positionable through such ejection port of such firearm for engaging said block for locating said cover member to hide said block and such ejection port from plain view.

23. The safety system of claim 22 wherein said upper portion of said cover member includes an ejection tab positionable in such loading chamber for engagement with such bolt ejection of said cover member from such loading chamber when said magazine block has been removed from such loading chamber.

24. The safety system of claim 21 wherein said block includes a front end portion and a rear end portion, said front end portion including a projecting tab for engaging such charging handle of such firearm to inhibit movement of such movable bolt and firing pin assembly.

25. The safety system of claim 21 wherein said block includes a front end portion and a rear end portion, said rear end portion including a projecting tab for engaging such bolt catch to hold such bolt catch in a lock back position.

26. A firearm safety system for attachment to an upper end of a magazine for preventing the operation of a firearm having a loading chamber, a movable bolt and firing pin assembly, a charging handle, and ejection port and means for automatically locking and releasing such magazine from a loading chamber, said safety system comprising:

an elongate magazine block including a lower portion having a pair of opposed shoulders for slidably inserting said block into the upper end of such magazine to locate said magazine block in such loading chamber when such magazine carrying said magazine block is inserted into such loading chamber, and an upper portion extending substantially vertically from said lower portion to trap such charging handle in a forward position to render such firearm inoperable when said magazine block is located in such loading chamber.

27. The safety system of claim 26 further comprising a cover member having opposite side portions, said one side portion including means for locking said cover member to said magazine block, said means being positionable through such ejection port of such firearm for engaging said block for locating said cover member to hide said block and such ejection port from plain view.

28. The safety of claim 27 wherein said means for locking includes a laterally extending male member having a pair of spaced elongate resilient elements, each of said elements including an outwardly extending locking shoulder for releasably connecting said element to said upper portion of said magazine block.

29. The safety system of claim 28 wherein said upper portion of said block includes a female receptor notch in said upper portion of said block for receiving said male member, said resilient elements partially passing transversely through said receptor notch to dispose said locking shoulder of each said element on a far side of said receptor notch.

30. The safety system of claim 29 wherein said receptor notch includes a pair of substantially opposed parallel end walls extending between said side portions defining a predetermined spacing, said elements being spaced apart to fit within said spacing when said cover member becomes locked to said magazine block.

31. The safety system of claim 26 wherein said block includes a front end portion and a rear end portion, said front end portion including a projecting tab for engaging such charging handle of such firearm to inhibit movement of such movable bolt and firing pin assembly.

32. The safety system of claim 26 wherein said block includes a front end portion and a rear end portion, said rear end portion including a projecting tab for engaging such bolt catch to hold such bolt catch in a lock back position.

* * * * *